US005821212A

United States Patent [19]

Peterson

[11] Patent Number: 5,821,212

[45] Date of Patent: Oct. 13, 1998

[54] RINSE AID AND PROCESS FOR STAINLESS STEEL

[75] Inventor: Joseph C. Peterson, Carmel, Ind.

[73] Assignee: Crown Technology, Inc., Indianapolis, Ind.

[21] Appl. No.: 947,994

[22] Filed: Oct. 9, 1997

Related U.S. Application Data

[60] Provisional application Nos. 60/040,075, Feb. 13, 1997 and 60/040,186, Mar. 12, 1997.

[51] Int. Cl.[6] ..... C23G 1/04; C23G 1/08; C11D 3/065; C11D 1/14

[52] U.S. Cl. ..... 510/258; 510/269; 510/274; 510/426; 510/375; 134/3; 134/41

[58] Field of Search ..... 510/269, 258, 510/274, 426, 375; 134/3, 41

[56] References Cited

U.S. PATENT DOCUMENTS

| | | | |
|---|---|---|---|
| 4,012,351 | 3/1977 | Hall et al. | 260/29.6 R |
| 4,806,161 | 2/1989 | Fabiny et al. | 106/14.12 |
| 5,052,421 | 10/1991 | McMillen | 134/2 |
| 5,421,897 | 6/1995 | Grawe | 134/6 |

FOREIGN PATENT DOCUMENTS 351772 1/1990 European Pat. Off. .

*Primary Examiner*—Douglas J. McGinty
*Attorney, Agent, or Firm*—Clifford W. Browning; Woodard, Emhardt, Naughton, Moriarty & McNett

[57] ABSTRACT

Hydrogen peroxide rinse aid solutions of the present invention added to hydrochloric acid rinse baths for acid pickled stainless steel enables hydrochloric acid rinse baths to easily remove stainless steel oxides and smutt from the surfaces of acid pickled stainless steel to produce a bright and clean finish that is comparable to the finish produced by nitric/hydrofluoric acid rinse systems.

6 Claims, 1 Drawing Sheet

RINSE AID AND PROCESS FOR STAINLESS STEEL

Figure 1:
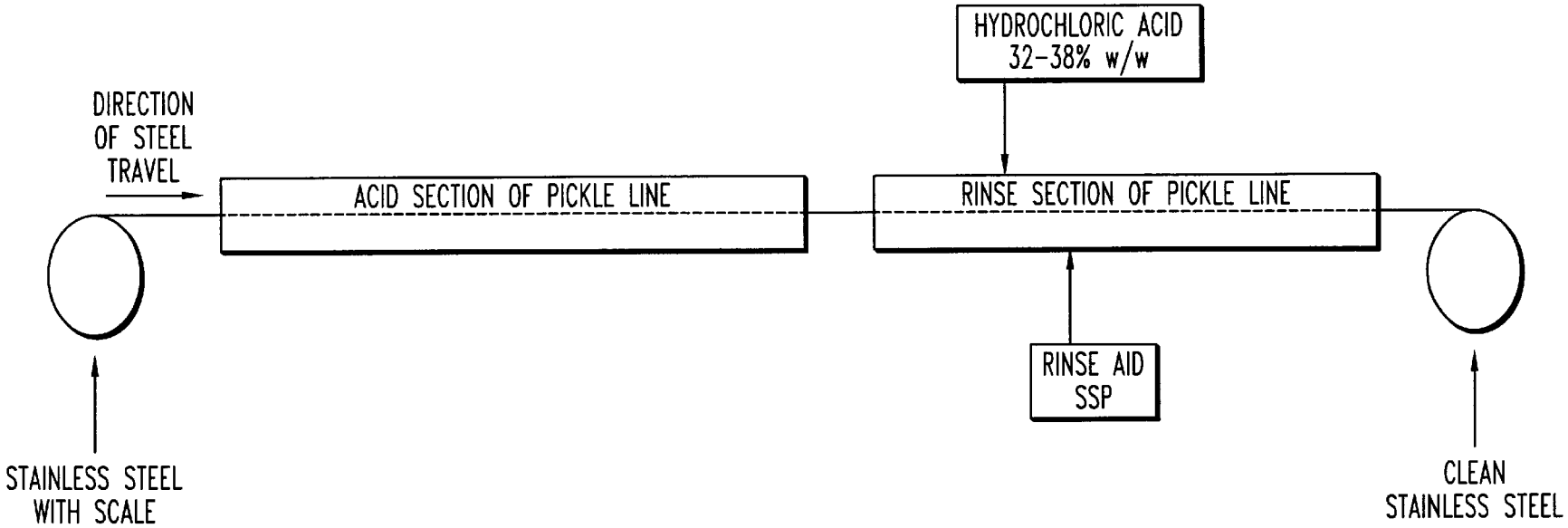

This application claims the benefit of U.S. provisional application No. 60/040,075, filed Feb. 13, 1997, and U.S. provisional applicational No. 60/040,186, filed Mar. 12, 1997.

BACKGROUND OF THE INVENTION

Normally, stainless steel is cleaned after acid pickling with nitric/hydrofluoric acids to remove stainless steel oxides and smutt from its surfaces in order to produce an acceptable bright and clean finish. However, the use of nitric acids creates toxic nitrous oxide fumes and is otherwise very costly to use. The steel industry is therefore now trying to use hydrochloric acid in place of nitric/hydrofluoric acids to clean acid pickled stainless steel, but the surfaces of the stainless steel are not being cleaned as well, primarily because hydrochloric acid is not an oxidizing acid.

SUMMARY OF THE INVENTION

It has been discovered that by adding a hydrogen peroxide rinse aid solution to a hydrochloric acid rinse bath for acid pickled stainless steel the rinse bath easily removes stainless steel oxides and smutt from the surfaces of the stainless steel to produce a bright and clean finish that is comparable to the finish produced by nitric/hydrofluoric acid rinse systems.

In a most preferred embodiment to date of the present invention, a hydrogen peroxide rinse aid solution comprising about 7.7% w/w hydrogen peroxide, about 3.57% w/w phosphoric acid, about 1.66% w/w sodium 2-ethylhexyl sulfate (a preferred wetting agent), and the balance water, has been added to hydrochloric acid stainless steel rinse baths as a rinse aid to improve significantly the cleaning ability of the bath. This hydrogen peroxide rinse aid solution was then metered into a stainless steel rinse bath at the rate of about 2 times the rate of addition to the rinse bath of 32–38% w/w hydrochloric acid.

Another embodiment of the present invention is a rinse aid for a hydrochloric acid rinse bath for acid pickled stainless steel, comprising from about 2 to 20% w/w hydrogen peroxide, about 3 to 4% w/w phosphoric acid, about 1 to 4% w/w sodium 2-ethylhexyl sulfate, and the balance water.

Another embodiment of the present invention is a rinse bath for acid pickled stainless steel, comprising about two parts of a first solution of from about 2 to 20% w/w hydrogen peroxide, about 3 to 4% w/w phosphoric acid, about 1 to 4% w/w sodium 2-ethylhexyl sulfate, and the balance water, and about one part of a second solution of from about 32 to 38% w/w hydrochloric acid.

Another embodiment of the present invention is a process for cleaning acid pickled stainless steel, comprising providing a rinse bath to receive acid pickled stainless steel; introducing a first solution of from about 2 to 20% w/w hydrogen peroxide, about 3 to 4% w/w phosphoric acid, about 1 to 4% w/w sodium 2-ethylhexyl sulfate, and the balance water, into the rinse bath of the providing step at a first rate; introducing a second solution of from about 32 to 38% w/w hydrochloric acid into the rinse bath of the providing step simultaneously with the introducing a first solution step at a second rate that is about one-half the first rate; and rinsing acid pickled stainless steel in the rinse bath.

A principal object of the present invention is to provide a rinse aid solution that may be added to hydrochloric acid rinse baths to enable stainless steel producers to produce high quality stainless steel finishes that are comparable to the finishes obtained with nitric/hydrofluoric acid rinse solutions using less toxic and less hazardous hydrochloric acid as the cleaning medium.

Related objects and advantages of the present invention will become apparent from the following descriptions of the drawings and the preferred embodiments to date.

BRIEF DESCRIPTION OF THE DRAWING FIGURES

FIG. 1 is a schematic drawing of a typical stainless steel pickling line showing the addition of the rinse aid solution of the present invention and 32–38% w/w hydrochloric acid to the rinse section of a typical acid pickling line for stainless steel.

DESCRIPTION OF THE PREFERRED FMBODIMENTS

In a most preferred embodiment to date, a hydrogen peroxide rinse aid solution to be added to a hydrochloric acid stainless steel rinse bath was prepared, comprising about 7.7% w/w hydrogen peroxide, about 3.57% w/w phosphoric acid, about 1.66% w/w sodium 2-ethylhexyl sulfate (a preferred wetting agent), and the balance water. This hydrogen peroxide rinse aid solution was then metered into a stainless steel pickling rinse bath at the rate of about 2 times the rate of addition of 32–38% w/w hydrochloric acid to the rinse bath (see FIG. 1). Acid pickled stainless steel thereafter processed through the rinse bath came out of the rinse bath with a high quality stainless steel finish that was bright and clear and was comparable to the stainless steel finish obtained with nitric/hydrofluoric acid rinse systems.

In testing completed to date, hydrogen peroxide rinse aid solutions comprising from about 2 to 20% w/w hydrogen peroxide, about 3 to 4% w/w phosphoric acid, about 1 to 4% w/w sodium 2-ethylhexyl sulfate (a preferred wetting agent), and the balance water, when added to a stainless steel pickling rinse bath at the rate of about 2 times the rate of addition of about 32 to 38% w/w hydrochloric acid, rinsed stainless steel oxide and smutt from acid pickled stainless steel and produced a stainless steel finish that was bright and clear.

During a recent 12 hour test run on a pickling line for stainless steel 409 that was running at an average speed of 10 tons of steel per hour, the most preferred hydrogen peroxide rinse aid solution of the present invention was added to the rinse tank in a separate stream at the rate of 1 gallon/minute while a separate stream of 0.5 gallons/minute of 32% w/w hydrochloric acid was added to the rinse tank. On average, for every ton of stainless steel processed, about 53.8 pounds of the hydrogen peroxide rinse aid of the present invention (about 7.7% w/w hydrogen peroxide, about 3.57% w/w phosphoric acid, about 1.66% w/w sodium 2-ethylhexyl sulfate, and the balance water), and about 29 pounds of 32% w/w hydrochloric acid were used. It was noted that whenever the flow of the hydrogen peroxide rinse aid solution of the present invention was stopped, the stainless steel leaving the rinse tank had black streaks on its surfaces.

Most typically, the hydrogen peroxide rinse aid solutions of the present invention are added to the second rinse section of the after the acid bath. The usage rate of the hydrogen peroxide rinse aid solutions of the present invention depends upon the degree of smutting present on the surfaces of the acid pickled stainless steel to be cleaned. The concentration of the hydrogen peroxide rinse aid solutions of the present invention in hydrochloric acid rinse baths may be regulated with a chemical titration method utilizing potassium permanganate. This method will tell how much peroxide, and thus how much of the rinse aid solution of the present invention, is present in the risen bath at any given time.

I claim:

1. A rinse aid for a hydrochloric acid rinse bath for acid pickled stainless steel, comprising from about 2 to 20% w/w hydrogen peroxide, about 3 to 4% w/w phosphoric acid, about 1 to 4% w/w sodium 2-ethylhexyl sulfate, and the balance water.

2. The rinse aid of claim 1 wherein hydrogen peroxide is present in about 7.7% w/w, phosphoric acid is present in about 3.57% w/w, sodium 2-ethylhexyl sulfate is present in about 1.66% w/w, and the balance water.

3. A rinse bath for acid pickled stainless steel, comprising about two parts of a first solution of from about 2 to 20% w/w hydrogen peroxide, about 3 to 4% w/w phosphoric acid, about 1 to 4% w/w sodium 2-ethylhexyl sulfate, and the balance water, and about one part of a second solution of from about 32 to 38% w/w hydrochloric acid.

4. The rinse bath of claim 3 wherein the components of the first solution are hydrogen peroxide present in about 7.7% w/w, phosphoric acid present in about 3.57% w/w, sodium 2-ethylhexyl sulfate present in about 1.66% w/w, and the balance water.

5. A process for cleaning acid pickled stainless steel, comprising providing a rinse bath to receive acid pickled stainless steel;

introducing a first solution of from about 2 to 20% w/w hydrogen peroxide, about 3 to 4% w/w phosphoric acid, about 1 to 4% w/w sodium 2-ethylhexyl sulfate, and the balance water, into the rinse bath of the providing step at a first rate;

introducing a second solution of from about 32 to 38% w/w hydrochloric acid into the rinse bath of the providing step simultaneously with the introducing a first solution step at a second rate that is about one-half said first rate; and rinsing acid pickled stainless steel in the rinse bath.

6. The method of claim 5 wherein the solution of the introducing a first solution step is about 7.7% w/w hydrogen peroxide, about 3.57% w/w phosphoric acid, about 1.66% w/w sodium 2-ethylhexyl sulfate, and the balance water.

* * * * *

UNITED STATES PATENT AND TRADEMARK OFFICE

CERTIFICATE OF CORRECTION

PATENT NO. : 5,821,212

DATED : October 13, 1998

INVENTOR(S) : PETERSON, Joseph C.

It is certified that error appears in the above-identified patent and that said Letters Patent is hereby corrected as shown below:

In column 2, line 19, please change "FMBODIMENTS" to --EMBODIMENTS--.

Signed and Sealed this

Sixteenth Day of March, 1999

*Attest:*

Q. TODD DICKINSON

*Attesting Officer*

*Acting Commissioner of Patents and Trademarks*